US011293210B2

(12) United States Patent
Schoedel

(10) Patent No.: US 11,293,210 B2
(45) Date of Patent: Apr. 5, 2022

(54) METHOD FOR CONTROLLING A DRIVE ARRANGEMENT FOR A FLAP OF A MOTOR VEHICLE

(71) Applicant: Brose Fahrzeugteile GmbH & Co. Kommanditgesellschaft, Bamberg, Bamberg (DE)

(72) Inventor: Sebastian Schoedel, Eckersdorf (DE)

(73) Assignee: Brose Fahrzeugteile GmbH SE & Co. Kommanditgesellschaft, Bamberg, Bamberg (DE)

( * ) Notice: Subject to any disclaimer, the term of this patent is extended or adjusted under 35 U.S.C. 154(b) by 169 days.

(21) Appl. No.: 16/395,782

(22) Filed: Apr. 26, 2019

(65) Prior Publication Data

US 2019/0330910 A1 Oct. 31, 2019

(30) Foreign Application Priority Data

Apr. 27, 2018 (DE) ..... 10 2018 110 249.6

(51) Int. Cl.
*E05F 15/41* (2015.01)
*E05F 15/73* (2015.01)

(52) U.S. Cl.
CPC ..... *E05F 15/41* (2015.01); *E05F 15/73* (2015.01); *E05Y 2400/554* (2013.01); *E05Y 2900/546* (2013.01)

(58) Field of Classification Search
None
See application file for complete search history.

(56) References Cited

U.S. PATENT DOCUMENTS 10,180,025 B2 * 1/2019 Conner ..... G07C 9/20
10,883,300 B2 * 1/2021 Wittelsbuerger ..... E05F 5/00
(Continued)

FOREIGN PATENT DOCUMENTS

| | | |
|---|---|---|
| DE | 102008057014 | 5/2010 |
| DE | 102016209915 | 12/2017 |
| EP | 1860265 | 12/2011 |

OTHER PUBLICATIONS

"German Search Report," for German Patent Application No. 102018110249.6 dated Dec. 20, 2018 (5 pages).

*Primary Examiner* — Marcus Menezes
(74) *Attorney, Agent, or Firm* — Pauly, DeVries Smith & Deffner LLC

(57) ABSTRACT

The disclosure relates to a method for controlling a drive arrangement for a flap of a motor vehicle by a control arrangement, wherein the drive arrangement comprises a first electric drive and a second electric drive that are coupled in each case to the flap in terms of providing a drive, wherein in a determining routine current values that occur during the motorized adjustment of the flap are determined for the drives, wherein in an anti-trap protection routine the determined current values of the two drives are monitored to establish if at least one a predetermined trapping event criterion exists that represents a trapping event and wherein in the event that a trapping event criterion has occurred a trapping event routine is performed. It is proposed that a trapping event criterion is defined by virtue of the fact that a predetermined relationship of the current value of the first drive to the current value of the second drive exceeds or is below a trapping event threshold.

14 Claims, 4 Drawing Sheets

(56) References Cited

U.S. PATENT DOCUMENTS

| | | | | |
|---|---|---|---|---|
| 2005/0168010 | A1* | 8/2005 | Cleland | E05F 15/41 296/146.8 |
| 2007/0273545 | A1* | 11/2007 | Hoshina | E05F 15/42 340/686.1 |
| 2015/0284983 | A1* | 10/2015 | Conner | E05F 15/75 318/3 |
| 2016/0222713 | A1* | 8/2016 | Jang | H02P 5/56 |
| 2017/0350180 | A1* | 12/2017 | Herthan | E05F 15/603 |
| 2019/0309558 | A1* | 10/2019 | Schoedel | H02P 21/13 |
| 2019/0330910 | A1* | 10/2019 | Schoedel | E05F 15/73 |
| 2020/0308891 | A1* | 10/2020 | Shi | E05F 15/614 |

* cited by examiner

METHOD FOR CONTROLLING A DRIVE ARRANGEMENT FOR A FLAP OF A MOTOR VEHICLE

CLAIM OF PRIORITY

This application claims the benefit of German Patent application No. DE 10 2018 110 249.6 filed on Apr. 27, 2018, the disclosure of which is incorporated herein by reference.

FIELD OF THE TECHNOLOGY

The disclosure relates to a method for controlling a drive arrangement for a flap of a motor vehicle, a control arrangement for performing such a method, a drive arrangement having such a control arrangement and also a flap arrangement having such a drive arrangement.

BACKGROUND

Within the scope of increasing the comfort factor in motor vehicles, the motorized adjustment of flaps has become particularly important. Such a flap is by way of example a tailgate, a trunk lid, a front hood, or the like.

On account of the ever increasing weight of flaps, it is known to provide the drive arrangement under discussion with two electric drives that engage by way of example with opposite-lying edges of the flap.

The motorized adjustment of a flap is fundamentally also associated with a risk of an obstacle becoming trapped. This relates in particular to a motorized closing movement of the flap during which a flap opening is continuously reduced in size until the flap seal is compressed.

In the case of the known method (DE 10 2016 209 915 A1) on which the disclosure is based, an anti-trap protection routine is provided in which the current values of two drives are compared with limit values, wherein different limit values are allocated to the two drives. If one of the limit values is exceeded, a trapping event routine is performed in which the two drives are switched off.

It is a challenge in the case of the known method to provide a uniformly high degree of detection reliability over the adjustment range of the flap when detecting a trapping event. By way of example, it is necessary to adjust the limit values that are allocated to the two drives to suit the respective conditions depending upon the flap position but also depending upon external boundary conditions such as a hillside location or the like. This often results in an undesired reduction of the sensitivity of the anti-trap protection routine with the result that the operational safety of the drive arrangement is limited overall. This procedure of adjusting the anti-trap protection routine to the respective prevailing conditions is discussed by way of example in EP 1 860 265 B1.

SUMMARY

The disclosure is based on the problem to configure and further develop known methods in such a manner that the operational safety of the drive arrangement in particular with respect to the function of the anti-trap protection is increased using simple means.

The above mentioned problem is achieved in the case of a method in with the disclosure.

In the first instance, it is assumed that the drive arrangement comprises a first electric drive and a second electric drive that are coupled in each case to the flap in terms of providing a drive. In this case, a determining routine is provided in which current values that occur during the motorized adjustment of the flap are determined for the drives.

It is further assumed that an anti-trap protection routine is provided, in which the determined current values of the two drives are monitored to establish if at least one predetermined trapping event criterion exists and wherein, in the event that a trapping event criterion has occurred, a trapping event routine is performed, in which by way of example the two drives are switched off.

In accordance with the proposal, it is now recognized that any trapping event, which is as a result of an obstacle being trapped in the flap opening, mainly has an asymmetrical effect on the flap. This means that the trapped obstacle rarely has an effect on the flap in a middle region of the flap but rather that this effect mostly occurs on the side of the flap. This means in turn that in the case of the at least slight flexibility of the flap the drive that is close to the trapped obstacle is initially 'braked' to a greater extent by the trapped obstacle than the respective other drive.

The term "flexibility" includes according to a broader understanding here not only an elastic deformation of the flap itself but rather also any play or the like that is present between the drives and the flap.

The solution in accordance with the proposal relates to the resulting knowledge that it is possible to detect in a simple manner an above mentioned asymmetrical trapping event, that a deviation of the drive behavior of the two drives relative to one another is detected.

In detail, it is proposed that a trapping event criterion is defined by virtue of the fact that a predetermined relation of the current value of the first drive to the current value of the second drive exceeds or is below a trapping event threshold.

Particularly advantageous in the case of the solution in accordance with the proposal is the fact that any detection of the trapping event is now fully dependent upon the respective prevailing conditions such as the flap position, hillside location or the like, since all these conditions affect the two drives uniformly. As a consequence, an overall greater operational safety for the drive arrangement is achieved.

Moreover, the solution in accordance with the proposal may be easily implemented, where necessary even without the necessity of additional measures with regard to the measuring technology. The reason for this is that often the above mentioned current values for controlling the drives are already generated in the control arrangement and may thus be used without further cost outlay within the scope of the anti-trap protection routine.

The current value may fundamentally correspond to the amount of the current that is flowing through the drive. Fundamentally, however, it is also possible to provide that the current value corresponds to the temporal deviation of the amount of the current that is flowing through the drive. This depends fundamentally upon the respective signals that are present for the current that is flowing through the drive.

Various embodiments relate to possibilities for the definition of the predetermined relationship of the current value of the first drive to the current value of the second drive. In the simplest scenario, the predetermined relationship relates to a difference or a relation. Other possibilities of the definition for the predetermined relationship are conceivable.

Various embodiments relate to variants for implementing the trapping event routine. In some embodiments, the drives are braked and/or stopped and/or reversed. In some embodiments, the two drives are controlled differently in the trapping event routine depending upon which drive is allocated the trapping event. By way of example, it may be provided that the drive that is not allocated the trapping event is reversed at a higher rate than the other drive in order in the shortest possible time to reinstate a synchronous operation between the two drives.

As mentioned above, the solution in accordance with the proposal relates to an asymmetrical trapping event that has a different effect on the two drives. Accordingly, in some embodiments, a further criterion that represents a trapping event is defined, wherein it is also possible to detect in a reliable manner that a symmetrical trapping event has occurred. Various embodiments relate to the fact that the current values of the two drives are to be checked individually or as a sum with regard to whether a trapping event threshold has been exceeded. The combination of the procedure of detecting in accordance with the proposal that an asymmetrical trapping event has occurred with the procedure of detecting that a symmetrical trapping event has occurred based on the further criterion that represents a trapping event results in an overall particularly high degree of operational safety for the drive arrangement.

Various embodiments include a control arrangement for performing the method in accordance with the proposal. Reference may be made to all statements relating to the method in accordance with the proposal.

Various embodiments include a drive arrangement for a flap of a motor vehicle having a first drive and a second drive, which in the assembled state are each coupled to the flap in terms of providing a drive, and having a control arrangement in accordance with the proposal. Reference is also to be made in this respect to all statements relating to the method in accordance with the proposal.

Various embodiments include a flap arrangement of a motor vehicle having a flap and a drive arrangement that is in accordance with the proposal and is allocated to the flap. Reference is also to be made in this respect to all statements relating to the method in accordance with the proposal.

In various embodiments, the flap may be adjusted about a horizontal flap axis, as is mostly the case with tailgates and trunk lids. An interesting fact in this case is that the two drives are coupled to the flap in terms of providing a drive on horizontally opposite-lying sides of the flap. It is possible with the solution in accordance with the proposal to detect particularly easily a side trapping event that has an effect as discussed above in an asymmetrical manner on the two drives. This applies in particular in accordance with various embodiments where the flap is configured accordingly so as to be able to deform in an elastic manner.

Various embodiments provide a method for controlling a drive arrangement for a flap of a motor vehicle by a control arrangement, wherein the drive arrangement comprises a first electric drive and a second electric drive that are coupled in each case to the flap in terms of providing a drive, wherein in a determining routine current values that occur during the motorized adjustment of the flap are determined for the drives, wherein in an anti-trap protection routine the determined current values of the two drives are monitored to establish if at least one predetermined trapping event criterion has occurred and wherein in the event that a trapping event criterion has occurred a trapping event routine is performed, wherein a trapping event criterion is defined by virtue of the fact that a predetermined relationship of the current value of the first drive to the current value of the second drive exceeds or is below a trapping event threshold.

In various embodiments, the respective current value corresponds to the amount of the current that is flowing through the respective drive, or that the respective current value corresponds to the temporal deviation of the amount of the current that is flowing through the respective drive.

In various embodiments, the predetermined relationship is a difference between the current value for the first drive and the current value for the second drive.

In various embodiments, the predetermined relationship is the relation between the current value for the first drive and the current value for the second drive.

In various embodiments, in the trapping event routine the drives are braked and/or stopped and/or reversed by the control arrangement.

In various embodiments, it is determined in the trapping event routine and based on an allocation criterion which of the two drives is allocated the trapping event.

In various embodiments, the allocation criterion is defined by virtue of the fact that the trapping event is allocated to the drive that has the higher current value in the trapping event routine.

In various embodiments, in the trapping routine the drive which is allocated the trapping event according to the allocation routine is controlled differently to the other drive.

In various embodiments, a further trapping event criterion is defined by virtue of the fact that the current value of the first drive exceeds a trapping event threshold and/or the current value of the second drive exceeds a trapping event threshold and/or the sum of the two current values of the two drives exceeds a trapping event threshold and/or that a further trapping event criterion is defined by virtue of the fact that the deviation of the adjusting rate of the flap from a desired adjusting rate of the flap exceeds a trapping event threshold.

Various embodiments provide a control arrangement for performing a method as described herein.

Various embodiments provide a drive arrangement for a flap of a motor vehicle having two drives, which in the assembled state are coupled to the flap in terms of providing a drive, and having a control arrangement as described herein.

Various embodiments provide a flap arrangement of a motor vehicle having a flap and having a drive arrangement in accordance with the disclosure that is allocated to the flap.

Various embodiments provide the flap may be adjusted about a horizontal flap axis and that the two drives are coupled to the flap in terms of providing a drive on horizontal opposite-lying sides of the flap.

In various embodiments, the flap is configured so as to be able to deform in an elastic manner such that a one-sided trapping event leads to an at least slight deformation of the flap.

BRIEF DESCRIPTION OF THE DRAWINGS

The disclosure is explained in detail below with the aid of a drawing illustrating only one exemplary embodiment. In the drawing.

DETAILED DESCRIPTION

Figure 1:
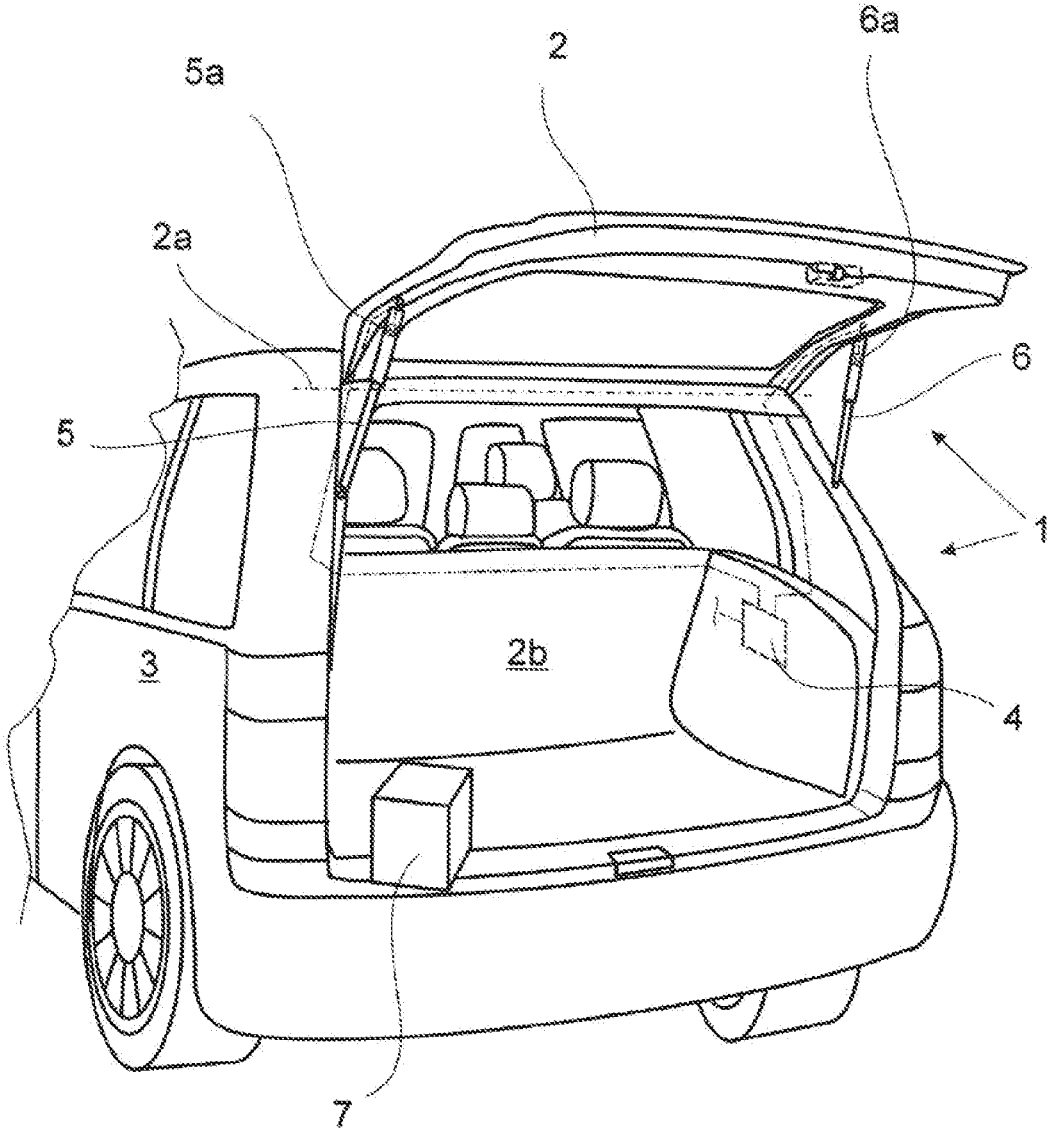
FIG. 1 illustrates the rear region of a motor vehicle having a flap arrangement for performing the method in accordance with the proposal.
Figure 2:
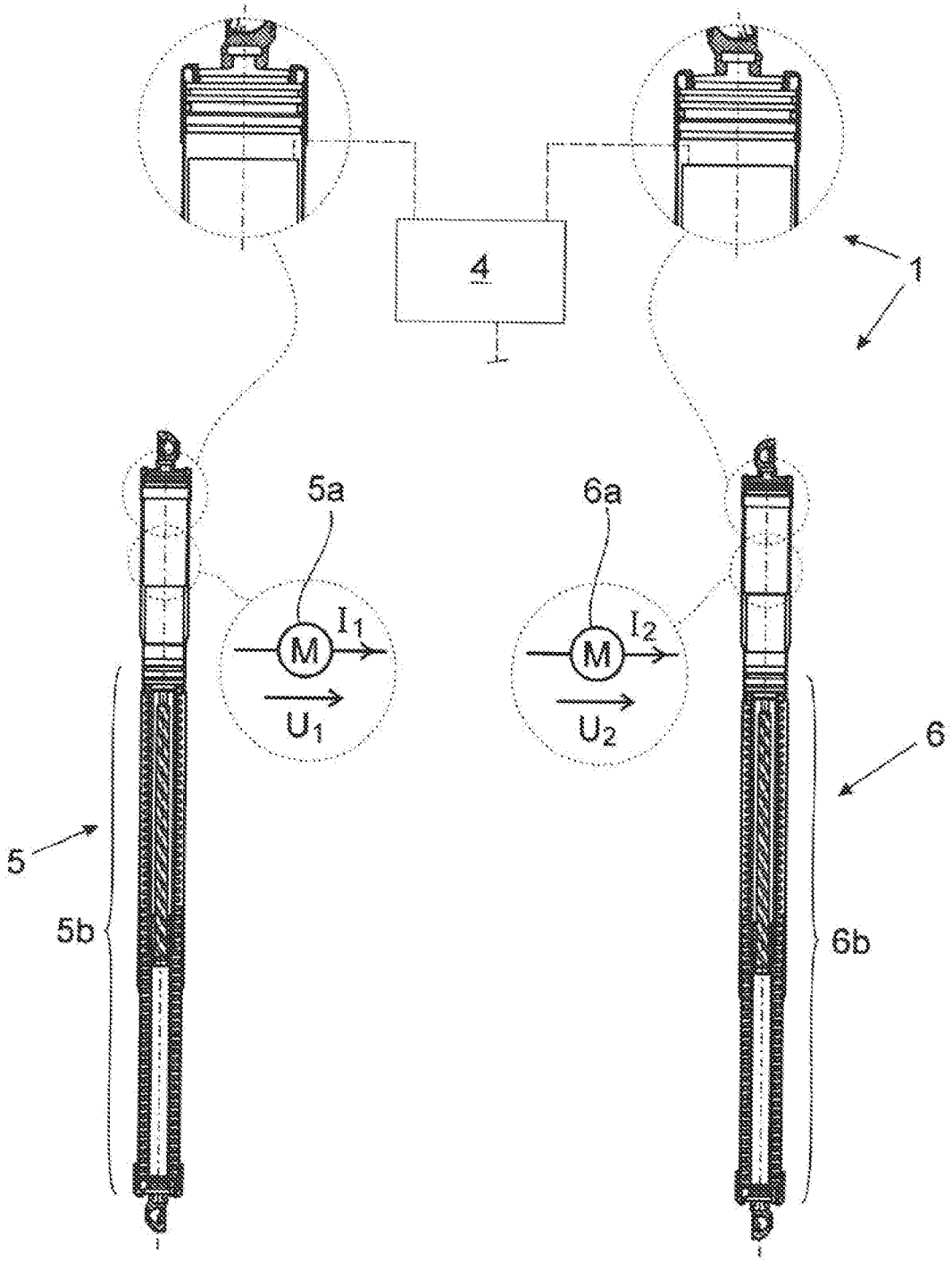
FIG. 2 illustrates a schematic view of the drive arrangement and the control arrangement of the flap arrangement in accordance with FIG. 1, FIG. 3 *a*) illustrates the current that is flowing through each of the two drives during a closing movement of the flap that is not hindered by a trapped obstacle and *b*) illustrates the current during a closing movement of the flap that is hindered by a trapped obstacle

The method in accordance with the proposal serves to control a drive arrangement 1 for a flap 2 of a motor vehicle 3 by means of a control arrangement 4.

The term "flap" includes in this case a tailgate, a trunk lid, a front lid, in particular an engine cover, a motor vehicle door in particular a side door or a rear door or the like.

In the case of the illustrated exemplary embodiment, the flap 2 is configured so as to be able to pivot about a flap axis 2*a*. In some embodiments, the flap axis 2*a* can be oriented essentially in a horizontal direction with the result that the force of the weight of the flap 2 acts at least over an adjustment range of the flap 2 in its closing direction.

The control arrangement 4 may be configured as a flap control device that is allocated to the flap 2 and interacts with a higher ranking motor vehicle control procedure. In lieu of this central approach, it is also possible for the control arrangement 4 to be a component of a central motor vehicle control procedure.

The drive arrangement 1 comprises a first electrical drive 5 and a second electrical drive 6 that are in each case coupled to the flap 2 in terms of providing a drive. The two drives 5, 6 are respectively a spindle drive having a motor unit 5*a*, 6*a* and a spindle-spindle nut-gear unit 5*b*, 6*b* that is connected downstream. An exemplary arrangement of such drives 5, 6 is disclosed in DE 10 2008 057 014 A1 that originates from the applicant and the contents of which are herewith made subject matter of the present application.

In a determining routine, current values $i_1$, $i_2$ that occur during the motorized adjustment of the flap 2 are determined for the drives 5, 6. The current values $i_1$, $i_2$ relate to the electrical currents $I_1$, $I_2$ that are flowing through the drives 5, 6, in particular through the motor units 5*a*, 6*a*, as will be explained later. The current values $i_1$, $i_2$ thus represent quite generally the drive forces that are applied in each case by the drives 5, 6 with the result that it is possible based on the current values $i_1$, $i_2$, of the drives 5, 6 to detect a trapping event that arises as a result of the trapping obstacle 7 that is illustrated only by way of example in FIG. 1.

Accordingly, an anti-trap protection routine it is provided in which the determined current values $i_1$, $i_2$ of the two drives 5, 6 are monitored to establish if a predetermined trapping event criterion has occurred.

As soon as a said predetermined criterion is fulfilled, it is concluded in the control arrangement 4 that a trapping event is detected. In accordance with the proposal, a trapping event routine is performed in the presence of a criterion that represents a trapping event. In the trapping event routine, the two drives 5, 6 are controlled in such a manner that the trapping event is eliminated. In the simplest scenario, the two drives 5, 6 are reversed for this purpose, as will be explained later.

An essential aspect is now that a criterion that represents a trapping event is defined by virtue of the fact that a predetermined relationship of the current values $i_1$ of the first drive 5 to the current value $i_2$ of the second drive 6 is above or below a trapping event threshold S. The term "trapping event threshold" is to be understood in this case as being broad. It includes the definition of an admissible range for the predetermined relationship of the current values $i_1$, $i_2$, wherein any deviation from the admissible range is evaluated in the control arrangement 4 as the detection of a trapping event. In this respect, the term "trapping event threshold" is not necessarily an individual limit value. Moreover, reference may be made to the fact that the trapping event threshold S may assume different value ranges depending upon the operating mode of the drive arrangement 1.

For the sake of completeness, reference may be made to the fact that the control procedure of the drive arrangement 1 may also include detecting and processing drive speeds or the like. By way of example, it is possible to allocate a rotary position transducer to at least one drive in order to determine such speed values. It is also conceivable that speed values are estimated based on current or voltage values that are allocated to the drives 5, 6. The same applies for the subsequent procedure of determining the drive or flap positions. All this is not excluded from the solution in accordance with the proposal, it is however only marginally relevant for explaining the solution in accordance with the proposal.

Figure 3:
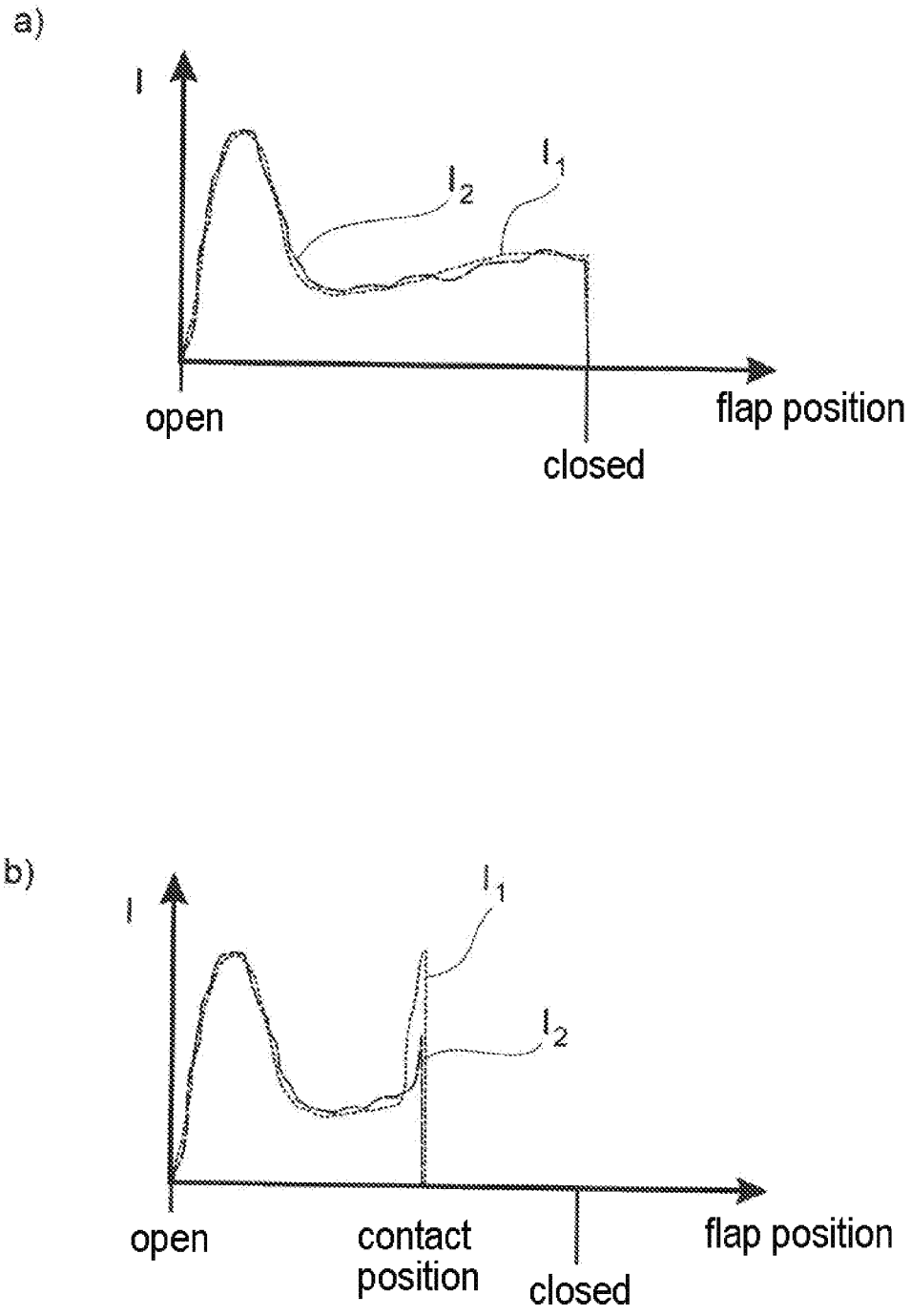

FIG. 3 illustrates the electrical currents $I_1$, $I_2$ that are flowing through the drives 5, 6 and in accordance with FIG. 3*a*) are essentially the same as the currents during an operation that is not hindered by a trapped obstacle.

Figure 4:
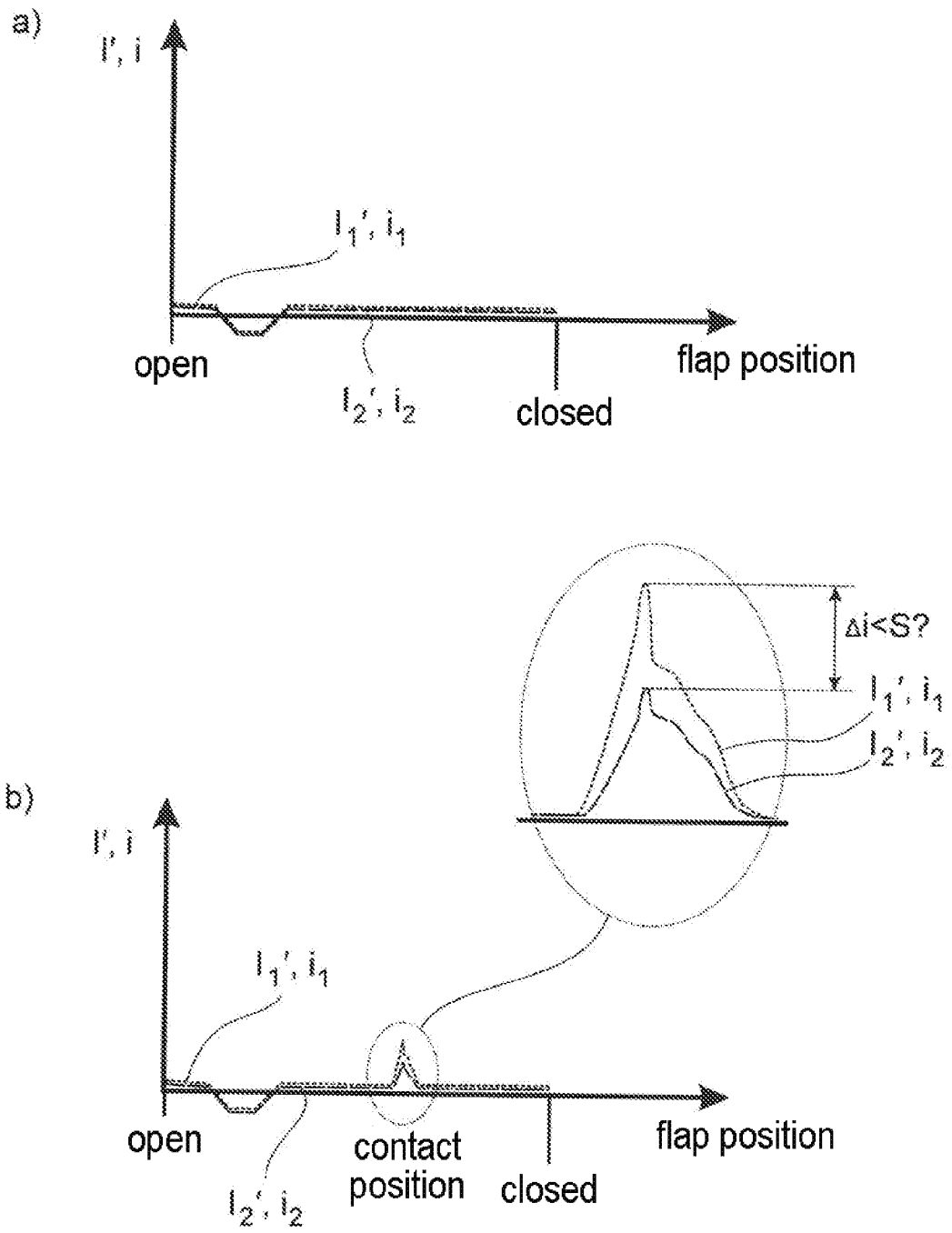
FIG. 4 illustrates the deviation of the current that is flowing through the drives a) for the situation in accordance with FIGS. 3*a*) and *b*) for the situation in accordance with FIG. 3*b*).

FIG. 4*a*) illustrates the temporal deviations $I'_1$, $I'_2$ of the currents $I_1$, $I_2$ that are flowing through the drives 5, 6. The temporal deviations $I'_1$, $I'_2$ are essentially identical to one another which is also appropriate with regard to the illustration in accordance with FIG. 3*a*).

FIG. 3*b*) now illustrates that an above described asymmetrical trapping event has occurred, said event being indicated by means of a trapping obstacle 7 that is arranged in FIG. 1 at the side in the flap opening 2*b*. In the case of at least a slight flexibility of the flap 2, the trapping obstacle 7 acts primarily in a braking manner on the first drive 5 and in a less braking manner on the second drive 6 during a first contact between the flap 2 and the trapping obstacle 7.

In the case of the movement control performed in this case and, in some embodiments, by the control arrangement 4, the movement control circuit ensures that the first drive 5 receives an increased amount of current in order to ensure that the two drives 5, 6 operate in a manner in which their movements are synchronized. This is illustrated in FIG. 3*b*). It is apparent from the illustration in accordance with FIG. 3*b*) that the currents $I_1$, $I_2$ that are flowing through the drives 5, 6 clearly deviate from one another after the first contact of the flap 2 in a contact position with the trapping obstacle 7. It is from this fact that the trapping event is detected in accordance with the proposal by means of the control arrangement 4.

The respective current value $i_1$, $i_2$, on which the anti-trap protection routine is based, may fundamentally correspond with the amount of the current that is flowing through the respective drive 5, 6. Alternatively, it is possible to provide that the respective current value $i_1$, $i_2$ corresponds to the temporal deviation $I'_1$, $I'_2$ of the amount of the current that is flowing through the respective drive 5, 6 and the following explanations are based on this. All the explanations in this respect apply accordingly for the first mentioned alternative.

In order to filter out manufacturing tolerances and all static influencing factors during the implementation of the anti-trap protection routine in accordance with the proposal, it can be provided that the currents $I_1$, $I_2$ that are flowing through the drives 5, 6 and/or the temporal deviations $I'_1$, $I'_2$ are subjected to a procedure of high pass filtering. This is performed in FIG. 4 in any case for the deviations $I'_1$, $I'_2$.

Different advantageous variants are conceivable for the definition of the predetermined relationship. In various embodiments, that can be particularly simple to implement in terms of providing a control, it is the case that the predetermined relationship is a difference between the current value $i_1$ for the first drive 5 and the current value $i_2$ for the second drive 6.

Alternatively, it is possible to provide that the predetermined relationship is the relation between the current value $i_1$ for the first drive 5 and the current value $i_2$ for the second drive 6.

Fundamentally, however, in the case of the predetermined relationship, the specification may be any specification that describes the two current values $i_1$, $i_2$ relative to one another.

These include by way of example also the correlation functions that are known from communications engineering.

It is assumed below that the predetermined relationship relates to the difference between the current value $i_1$ for the first drive 5 and the current value $i_2$ for the second drive 6. All the statements in this respect apply accordingly for all other variants for the predetermined relationship. The difference between the two current values $i_1$, $i_2$ is indicated in FIG. 4*b*) by the reference numeral "Δi".

In the trapping event routine, quite general measures are performed for terminating the trapping event. It can be provided that in the trapping event routine the drives 5, 6 are braked and/or stopped and/or reversed by means of the control arrangement 4. In various embodiments, these measures affect the two drives 5, 6 in an identical manner.

In view of the fact that the trapping event that is to be detected using the solution in accordance with the proposal can be an asymmetrical trapping event in the above described manner, the drives 5, 6 can be controlled differently in the trapping event routine. For this purpose, it is to be determined in the trapping event routine and based on an allocation criterion which of the two drives 5, 6 is allocated the trapping event. The allocation of the trapping event to one of the two drives 5, 6 depends upon which drive 5, 6 is affected more than the respective other drive. In the case of the illustrated exemplary embodiment, it is the case that, as the first contact is made between the flap 2 and the trapped obstacle 7, the first drive 5 is braked by the trapped obstacle 7 to a greater extent than the second drive 6 with the result that the trapping event is allocated in the above terms to the first drive 5.

Consequently, it can be provided that the allocation criterion is defined by virtue of the fact that the trapping event is to be allocated to the drive 5, 6 that has the higher current value $i_1$, $i_2$ in the trapping event routine. In accordance with FIG. 4, it is obviously the first drive 5 in this case.

In a further embodiment, once it has been detected which drive 5, 6 has been allocated the trapping event based on the above allocation criterion, the relevant drive 5, 6 is controlled differently to the other drive 6, 5. In the case of the illustrated embodiment, it is by way of example conceivable that the second drive 6 is reversed at a greater rate than the first drive 5 in order to avoid one of the two drives 5, 6 becoming jammed and to safeguard a synchronous as possible operation of the two drives 5, 6.

Reference has already been made to the fact that in addition to the procedure in accordance with the proposal of detecting an asymmetric trapping event, it is possible to use a further method for detecting an in particular symmetrical trapping event. Accordingly, it can be that a further trapping event criterion is defined by virtue of the fact that the current value $i_1$ of the first drive 5 exceeds a trapping event threshold and/or the current value $i_2$ of the second drive 6 exceeds a trapping event threshold and/or the sum of the two current values $i_1$, $i_2$ exceeds a trapping event threshold. As an alternative or in addition thereto, it is possible to define a further trapping event criterion by virtue of the fact that the deviation of the adjusting rate of the flap 2 from a desired adjusting rate of the flap 2 exceeds a trapping event threshold. All above mentioned trapping event thresholds are naturally different for the respective trapping event criterion.

The combination of the procedure in accordance with the proposal of detecting an asymmetrical trapping event with the last mentioned variant and the procedure for detecting an in particular symmetrical trapping event result when taken together in a quite particularly high operational safety of the drive arrangement, in particular with regard to the anti-trap protection.

According to various embodiments, the control arrangement 4 that is configured so as to perform the method in accordance with the proposal is disclosed. An aspect in this case is the fact that the control arrangement 4 is configured so as to implement the trapping routine and the anti-trap protection routine. Reference may be made to all the statements in this respect relating to the method in accordance with the proposal.

According to various embodiments, the drive arrangement 1 having the first drive 5 and the second drive 6, which are coupled in the assembled state in each case to the flap 2 in terms of providing a drive, and having an above mentioned control arrangement 4 are disclosed.

Also in this respect, reference may be made to all statements relating to the method in accordance with the proposal.

According to various embodiments, finally a flap arrangement of a motor vehicle having a flap 2 and a drive arrangement 1 that is in accordance with the proposal and allocated to the flap 2 is disclosed. Also in this respect reference may be made to all statements in this respect relating to the method in accordance with the proposal.

With regard to the flap arrangement in accordance with the proposal, reference may also be made to the position of the flap axis 2*a* that, as mentioned above, in some embodiments can be configured in a horizontal manner, wherein the two drives 5, 6 are coupled to the flap 2 on horizontal opposite-lying sides of the flap 2 in terms of providing a drive. In this case, the flap 2, as mentioned further above, provides a specified deformability in such a manner that a one-sided trapping event leads to an at least slight deformation of the flap 2. As a consequence, it is possible to implement the solution in accordance with the proposal in a particularly effective manner.

The invention claimed is:

1. A method for controlling a drive arrangement for a flap of a motor vehicle by a control arrangement, wherein the drive arrangement comprises a first electric drive and a second electric drive that are coupled in each case to the flap in terms of providing a drive, wherein in a determining routine, current values that occur during motorized adjustment of the flap are determined for the drives, wherein in an anti-trap protection routine, the determined current values of the two drives are monitored to establish if at least one predetermined trapping event criterion has occurred and wherein in the event that a trapping event criterion has occurred a trapping event routine is performed, wherein the at least one trapping event criterion is defined in that a predetermined relation of the current value of the first drive to the current value of the second drive exceeds or is below a trapping event threshold, wherein the trapping event criterion represents an asymmetrical trapping event, in which a trapping obstacle is arranged at a side of a flap opening.

2. The method as claimed in claim 1, wherein the current value of the first drive corresponds to the amount of the current that is flowing through the first drive and the current value of the second drive corresponds to the amount of the current that is flowing through the second drive, or, wherein the current value of the first drive corresponds to the temporal deviation of the amount of the current that is flowing through the first drive and the current value of the second drive corresponds to the temporal deviation of the amount of the current that is flowing through the second drive.

3. The method as claimed in claim 1, wherein the predetermined relation of the current value of the first drive to the current value of the second drive is a difference between the current value of the first drive and the current value of the second drive.

4. The method as claimed in claim 1, wherein the predetermined relation of the current value of the first drive to the current value of the second drive is a ratio between the current value of the first drive and the current value of the second drive.

5. The method as claimed in claim 1, wherein in the trapping event routine the drives are braked and/or stopped and/or reversed by the control arrangement.

6. The method as claimed in claim 1, wherein in the trapping event routine, a trapping event is allocated to one of the first drive and the second drive, wherein the allocation is based on an allocation criterion.

7. The method as claimed in claim 6, wherein the allocation criterion is defined in that the trapping event is allocated to the drive that has the higher current value in the trapping event routine.

8. The method as claimed in claim 7, wherein in the trapping event routine, the drive which is allocated the trapping event according to the allocation routine is controlled differently to the other drive.

9. The method as claimed in claim 1, wherein a second trapping event criterion is defined in that the current value of the first drive exceeds a first drive trapping event threshold, the current value of the second drive exceeds a second drive trapping event threshold, the sum of the two current values of the two drives exceeds a sum trapping event threshold, or that the second trapping event criterion is defined in that the deviation of an adjusting rate of the flap from a desired adjusting rate of the flap exceeds a rate trapping event threshold.

10. The control arrangement for performing the method as claimed in claim 1.

11. The drive arrangement for the flap of the motor vehicle having the two drives, which in an assembled state, are coupled to the flap for moving the flap, and having the control arrangement as claimed in claim 10.

12. A flap arrangement of the motor vehicle having the flap and having the drive arrangement in accordance with claim 11 that is allocated to the flap.

13. The flap arrangement as claimed in claim 12, wherein the flap may be adjusted about a horizontal flap axis and that the two drives are coupled to the flap in terms of providing a drive on horizontal opposite-lying sides of the flap.

14. The flap arrangement as claimed in claim 12, wherein the flap is configured so as to be able to deform in an elastic manner such that a one-sided trapping event leads to an at least slight deformation of the flap.

* * * * *